US006624577B2

(12) United States Patent
Mészáros et al.

(10) Patent No.: US 6,624,577 B2
(45) Date of Patent: Sep. 23, 2003

(54) TUNGSTEN-RHENIUM FILAMENT AND METHOD FOR PRODUCING SAME

(75) Inventors: István Mészáros, Budapest (HU); Tamás Gál, Györössy kert (HU); György Nagy, Budapest Erdösor u. (HU); Béla Szeles, Váralja u. (HU)

(73) Assignee: General Electric Company, Schenectady, NY (US)

( * ) Notice: Subject to any disclaimer, the term of this patent is extended or adjusted under 35 U.S.C. 154(b) by 266 days.

(21) Appl. No.: 09/812,010

(22) Filed: Mar. 19, 2001

(65) Prior Publication Data

US 2002/0145373 A1 Oct. 10, 2002

(51) Int. Cl.[7] ..... H01J 17/04; H01J 61/04; H01J 1/88; H01J 9/04; H01K 1/50

(52) U.S. Cl. ..... 313/633; 313/271; 313/579; 445/48

(58) Field of Search ..... 313/271, 579, 313/633; 148/423, 668, 673; 445/48

(56) References Cited

U.S. PATENT DOCUMENTS

| | | | | |
|---|---|---|---|---|
| 4,413,205 A | | 11/1983 | Ooms | 313/579 |
| 5,072,147 A | * | 12/1991 | Pugh et al. | 313/341 |
| 5,708,326 A | * | 1/1998 | Mizohata et al. | 313/495 |
| 6,066,019 A | | 5/2000 | Bewlay | 445/28 |
| 6,165,412 A | * | 12/2000 | Lunk et al. | 419/4 |
| 6,190,466 B1 | * | 2/2001 | Apagyi et al. | 148/423 |
| 6,419,758 B1 | * | 7/2002 | Bewlay et al. | 148/273 |

FOREIGN PATENT DOCUMENTS

GB 1053020 12/1966

OTHER PUBLICATIONS

The Metallurgy of Doped/Non–Sag Tungsten, Edited by Erwin Pink and Laszlo Bartha, 1989, 87 pages.

* cited by examiner

*Primary Examiner*—Vip Patel
*Assistant Examiner*—Matt Hodges
(74) *Attorney, Agent, or Firm*—Pearne & Gordon LLP

(57) ABSTRACT

A tungsten-rhenium filament for an operation temperature between 2900 and 3200° K is disclosed. The filament comprises an aluminum-potassium-silicon (AKS) additive. The filament has a grain microstructure comprising substantially exclusively elongated interlocking grains with a Grain Aspect Ratio (GAR) not less than 12. The rhenium content of the filament is between 0.2–0.4% by weight. A method for manufacturing a rhenium-tungsten filament is also disclosed. The method comprises the following steps. An AKS doped tungsten-rhenium alloy powder is prepared with a rhenium content of 0.2–0.4% by weight. The alloy powder is pressed and presintered, and thereafter sintered with direct current. A rhenium-tungsten filament is formed, which has a metastable crystal structure. The filament is annealed below the recrystallisation temperature, and recrystallised above the crystallization temperature. There is also provided a halogen incandescent lamp with a glass envelope enclosing a tungsten-rhenium filament.

17 Claims, 2 Drawing Sheets

TUNGSTEN-RHENIUM FILAMENT AND METHOD FOR PRODUCING SAME

FIELD OF THE INVENTION

This invention relates to a tungsten-rhenium filament for high color temperature operation. The invention also relates to a method for manufacturing such a rhenium-tungsten filament, and a halogen incandescent lamp comprising the tungsten-rhenium filament.

BACKGROUND OF THE INVENTION

Tungsten filaments for incandescent lamps are well known in the art. It is also known that the operation temperature of the filaments determine the light output of the lamp. High operation temperatures of typically between 2900° K and 3200° K are required for certain applications, as stage- and studio lamps, and special headlamps. However, the lifetime of the filaments tends to decrease dramatically with high operation temperatures. This effect is largely due to the sagging of the filament. Therefore, there is a constant need for improving the non-sag properties of the filaments, particularly at high temperatures.

In order to improve the non-sag property of the filaments, it has been suggested to include small amounts of rhenium in the tungsten. Typically, 1–3% by weight of rhenium is added. E. g. UK Patent No. 1,053,020 teaches the addition of rhenium between 0.1–7% by weight, preferably 3% by weight, in order to improve the mechanical properties of the tungsten. The improvement is accomplished by promoting the formation of elongated grains in the tunsten, as it undergoes a recrystallisation during the lifetime of the lamp. The grain formation is also supported by grain shaping additives, as aluminum, potassium and silicon, commonly known as AKS. The use of such additives is also explained among others in the publication "The Metallurgy of Doped/Non Sag Tungsten" by E. Pink and L. Bartha, published by Elsevier Applied Science, London and New York, 1989.

Further, U.S. Pat. No. 5,072,147 suggests the use of tungsten filaments that are largely recrystallised, and which have a grain structure with elongated interlocking grains. In order to quantify the quality of the grains, it is suggested using the so-called grain shape parameter, which is based partly on the value of the Grain Aspect Ratio (GAR). U.S. Pat. No. 5,072,147 stresses the importance of achieving a large value of the GAR, because it is seen as a key factor for the non-sag property of the filament.

U.S. Pat. No. 6,066,019 also mentions the use of a tungsten-rhenium filament, which is recrystallised before the lamp is actually used. This is necessary because the filament need to be mechanically supported during the recrystallisation. The recrystallisation temperature is above 2600° C., i.e. above 2870° K.

U.S. Pat. No. 4,413,205 also suggests the use of rhenium for improving the properties of tungsten, but not for improving the grain structure of the filament. Instead, the surface of the integral conductors is improved against the attacks of bromine. The suggested composition contains at least 0.1%, but preferably between 1–3% by weight of rhenium.

While the use of the AKS dopants and the use of rhenium in tungsten is well known for the filaments of incandescent lamps, their use in high color temperature lamps is problematic. The addition of AKS facilitates the grain forming process. However, with increasing color temperatures, particularly above operating temperatures of 2800° K, an increased tendency of blister formation on the grain boundaries is observed. These blisters weaken the grain structure, and accelerates the filament degrading process. The formation of the blisters is attributed to the potassium. The addition of rhenium improves the grain structure of the filament, and thereby compensates the negative effect of the potassium, at least partly. It was believed that the addition of at least 1% by weight rhenium is necessary to achieve the desired non-sag properties of filaments operating at high temperatures. It was observed that the grain structure, and thereby the non-sag property improves with higher amounts of rhenium, but even small amounts (as little as 1%) increase the recrystallisation temperature of the tungsten filament above the critical value of 2600–2700° K. With presently available mass production technology, the filaments may be heated up to approx. 2750° K during the recrystallisation. Raising the recrystallisation temperature above this value would significantly increase the cost of the filament manufacturing.

Therefore, there is a need for a tungsten-rhenium filament with a crystal structure that ensures favorable mechanical properties also at high operating temperatures, and which may be manufactured economically.

SUMMARY OF THE INVENTION

In an embodiment of the first aspect of the present invention, there is provided a tungsten-rhenium filament for an operating temperature between 2900–3200° K. The filament comprises AKS additive, and has a grain microstructure which comprises substantially exclusively elongated interlocking grains with a Grain Aspect Ratio (GAR) not less than 12. Throughout this description, the term GAR will be used as defined in the U.S. Pat. No. 5,072,147. Further, the filament has a rhenium content of 0.2–0.4% by weight.

In a second aspect of the invention, the method for manufacturing the rhenium-tungsten filament comprises the following steps: An AKS doped tungsten-rhenium alloy powder is prepared, where the alloy powder has a rhenium content of 0.2–0.4% by weight. The alloy powder is pressed and presintered. Thereafter, the alloy powder is sintered with direct current. A filament with a metastable crystal structure is formed of the sintered alloy. The filament is annealed while in the metastable crystal structure, and the annealing is done on a temperature below the recrystallisation temperature. The filament is recrystallised at a temperature above the recrystallisation temperature to achieve a stable crystal structure. This crystal structure has elongated interlocking grains with a GAR not less than 12.

In another embodiment of a further aspect of the invention, the halogen incandescent lamp comprises a glass envelope enclosing a tungsten-rhenium filament. The filament comprises an AKS additive, and has a grain microstructure comprising substantially exclusively elongated interlocking grains with a Grain Aspect Ration (GAR) not less than 12. The rhenium content of the filament is 0.2–0.4% by weight.

BRIEF DESCRIPTION OF DRAWINGS

The invention will be now described with reference to the enclosed drawings, where.

DETAILED DESCRIPTION OF THE INVENTION

Figure 1:
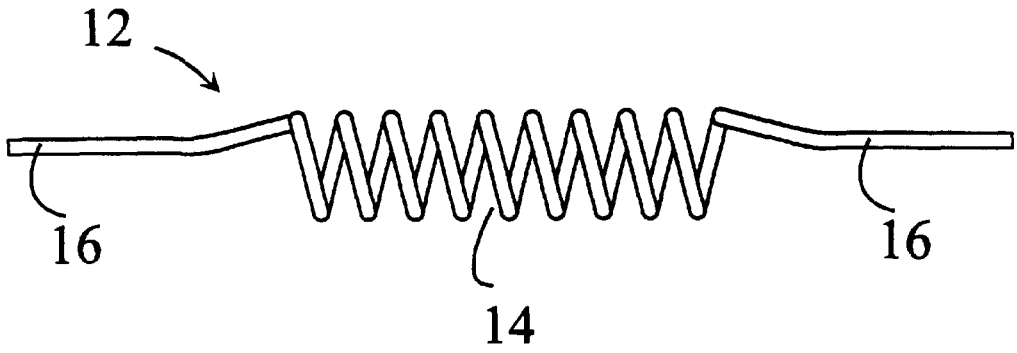
FIG. 1 shows a filament of an incandescent lamp.
Figure 2:
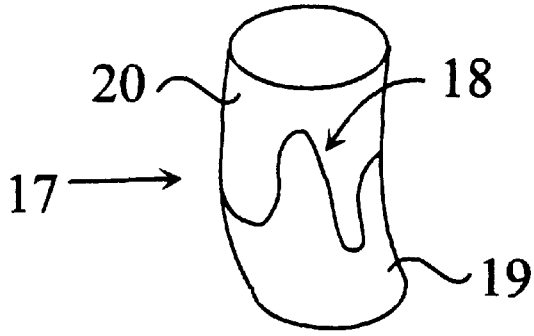
FIG. 2 is an enlarged part of FIG. 1, illustrating the grain structure of the filament.
Figure 4:
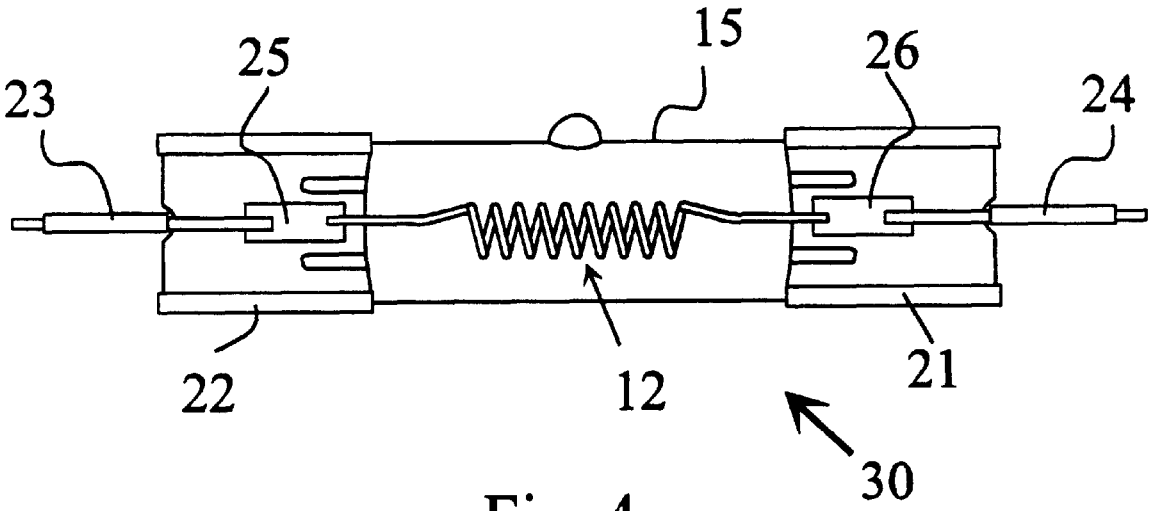
FIG. 4 illustrates a halogen lamp comprising the filament of FIG. 1.

Referring now to FIGS. 1 and 2, there is shown a filament 12 with a coiled portion 14 and an uncoiled portion 16. In the shown embodiment, the filament 12 is single coiled. However, coiled-coiled filaments are also commonly used, particularly for higher wattage lamps. The filament 12 is designed for high color temperature operation, i.e. in the switched on state, its operating temperature is above 2900° K, and in extreme cases it may even reach 3200° K.

Usually, the filament 12 is symmetric, and there are two uncoiled portions 16, at each end of the coiled portion 14, extending in the axis of the coiled portion 14, as shown on the filament 12 in FIG. 1, or the end portions may be perpendicular to the coiled portion 14. Alternatively, it is also customary that one of the uncoiled portions 16 is at an angle to the other uncoiled portion 16, e.g. essentially perpendicular to the axis of the coiled portion 14. This arrangement is dependent on the specific application, i.e. the type of the incandescent lamp where the filament structure is to be used. Such lamps, e.g. stage- and studio lamps, or lamps for the headlights of automobiles, are well known, and need no further explanation.

In order to meet the mechanical requirements for filaments of incandescent (halogen) lamps of the highest luminous efficiency, i.e. lamps with filaments operating on the highest temperatures, the filament structure must retain its shape on the operating temperature. This is commonly referred to as a non-sag property of the filament. The quality of the non-sagging of a filament at high temperature depends on several wire parameters. The most important of these parameters is considered to be the interlocking grain structure of the material of the tungsten filament in its recrystallised condition. The Grain Aspect Ratio, shortly GAR, is a measure of the interlocking of the grains, as it is explained in detail in the U.S. Pat. No. 5,072,147.

It has been found that filaments need to have a GAR at least 12 but preferably higher than 12 at high operating temperatures. It is noted that the practically achievable GAR is also dependent on the wire diameter used in the filament. For relatively thick wires, i.e. in the order of 300–400 microns, a GAR of 12 or higher is considered as an acceptable value. For thinner wires, in the order of 50–200 microns, higher GAR values can be achieved, with preferred values above at least 50, or even above 100. With other words, in case of incandescent lamps operating at very high temperatures the desired stability and length of service life of the lamp can only be achieved by using tungsten wires which contain large crystallites and a good interlocking grain structure. FIG. 2 shows a segment 17 of the filament 12 in FIG. 1. The segment 17 contains two grains 19 and 20 with a grain interface 18 between them. It is desired to accomplish a large area of the interface 18, which will then ensure good connection between the grains 19 and 20, and therewith the filament 12 will be resistant to sag, and better withstands vibration. The interlocking grain structure, as it is well known, may be accomplished by K, Si, Al doping of the tungsten wire for filaments of relatively low operating temperatures. However, at high temperatures the potassium develops blisters or bubbles at the grain interfaces, which weaken the filament 12. In order to prevent the above effect, the filament 12 is made of a tungsten-rhenium alloy. The filament 12 also comprises AKS additive. The amount of this additive may be limited. It is foreseen that the filament 12 comprises less than 100 ppm potassium. The aluminum and silicon are used only as the carrier material for the potassium. Therefore, these carrier materials may be limited to less than 10 ppm for the silicon, and to less than 13 ppm for the aluminum.

The filament contains between 0.2–0.4% by weight of rhenium. The preferred composition contains 0.3% by weight of rhenium. The rhenium is distributed uniformly in the volume of the tungsten. This is ensured during the manufacturing of the filament, as will be explained below. Such a filament having the above described composition may be manufactured to have a grain microstructure comprising substantially exclusively elongated interlocking grains. With other words, there will be practically no fine and round grains, but the whole filament will consist of only elongated grains, which interlock with each other along interfaces with a large surface. The GAR achievable with the above material composition is not less than 12 for a wire thickness of 400 microns, but may be even higher for smaller wire diameters.

The suggested composition of the filament is able to combine the advantages of doping with K, Si, Al, and those of alloying with Re. Surprisingly, it was found that with a rhenium content of as low as 0.2–0.4% by weight, very good grain structure was accomplished with GAR parameters above 12 and more. This way the non-sag qualities of the filaments of special incandescent lamps operating at high temperature significantly increase, while it is still possible to produce the filaments with standard manufacturing equipment. This means in practice that the production output analogous to the applied traditional K, Si, Al doped tungsten wire may be reached, while providing the same crack-proof quality and filament winding quality.

With the proposed tungsten-rhenium filament the hot tensile strength (HTS) characterizing the interlocking grain structure will increase, but the end of the recrystallization temperature (halogen) will remain within the 2400–2500° C. range usual in filament production. The low Re content does not affect the cycle time during the manufacturing process of the halogen lamp, which is an important parameter of the mass production. Long process cycles inevitably raise the production costs. Considering the fact that high temperature lamps have a much shorter lifetime than lamps with a lower filament temperature, a low price/lifetime ratio is very important in the market. Therefore the duty cycle of the production must be short. For this reason, it is important to keep the recrystallisation temperature below the critical value of 2400–2500° C., i.e. approx. 2650–2750° K.

Figure 3:
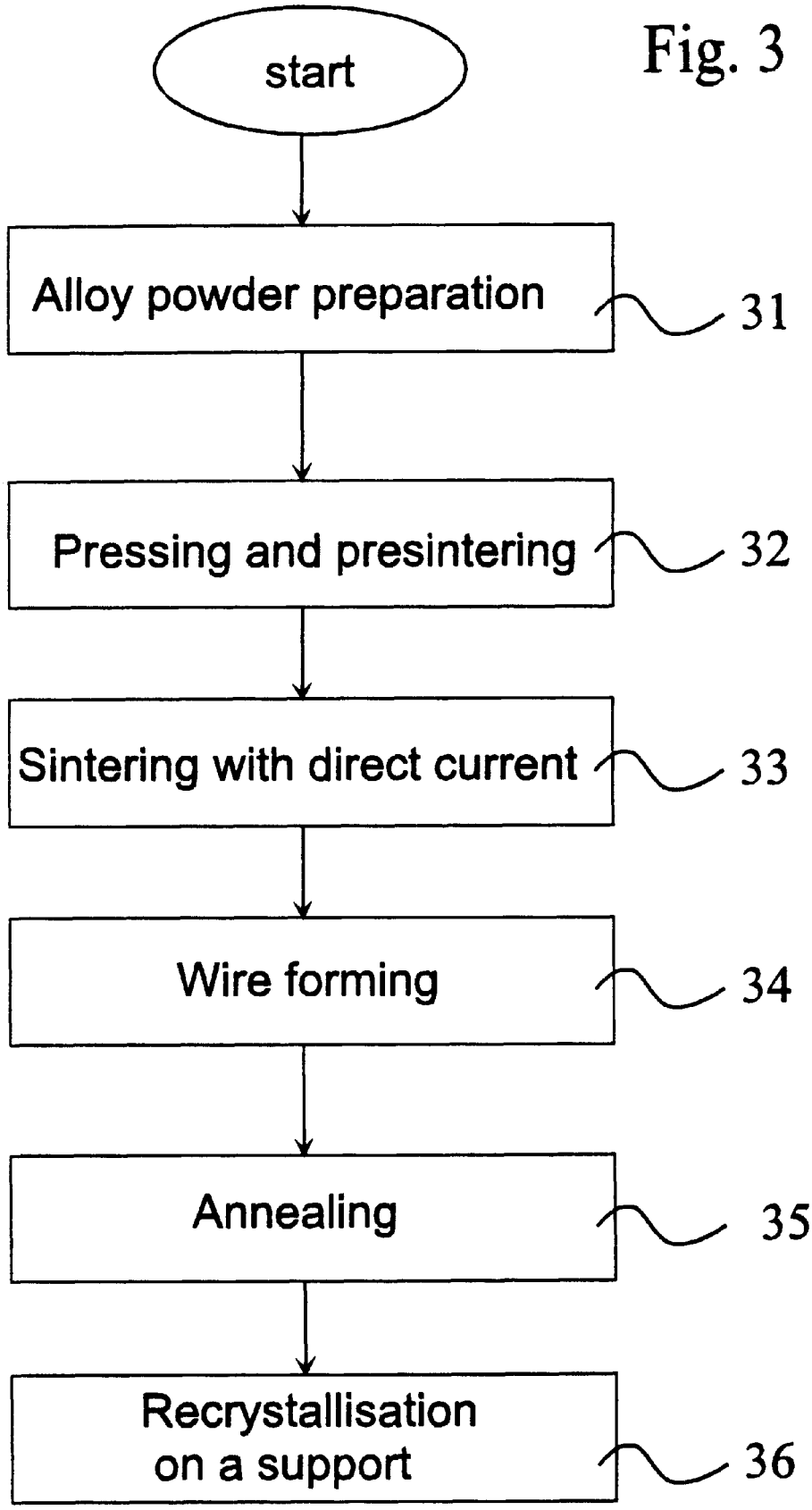
FIG. 3 is a flow chart of the method for manufacturing the filament.

Filaments similar to the filament 12 in FIG. 1 were produced by the following process, as also illustrated by steps 31 to 36 in FIG. 3.

The base material for the filament is AKS doped tungsten-rhenium alloy powder. The process starts with the preparation of the alloy powder, see step 31 in FIG. 3. The alloy has a rhenium content of 0.2–0.4% by weight, and it is distributed evenly in the tungsten with known techniques, e.g. by dry or wet doping, together with the AKS or separately. The doping of the tungsten and the powder preparation is known by itself.

Following the alloy powder preparation, the alloy powder is pressed and pre-sintered, see step 32. The pressing and presintering is also made in a known manner, in order to prepare the alloy powder for the sintering. Thereafter, as shown in step 33, the alloy powder is sintered with direct current. This is a known process step in powder metallurgy.

The specific parameters of the sintering, i.e. temperature, atmosphere composition and sintering current are dependent of the geometrical and other parameters of the furnace. Typical values of sintering current are between 3000 and 6000 A, and the sintering is done in a hydrogen atmosphere. The sintering of the alloy with direct current effectively blocks the later blister formation by the potassium on the grain interfaces.

After the sintering, a rhenium-tungsten wire is formed from the sintered alloy ingot, see step 34, and a filament is made from the wire. The forming of a filament is done with known metalworking techniques, e.g. rolling, swaging and wire drawing. The alloy now has a metastable crystal structure. This state is considered metastable, because the filament recrystallises at higher temperatures, either before actual operation or during operation. For high operating temperature filaments, the recrystallisation must be done before the filament is finally mounted in the lamp. After the recrystallisation the recrystallised structure will remain stable even at lower temperatures.

After the wire forming in step 34, the filament is annealed, as illustrated in step 35. The filament is annealed while in the metastable crystal structure. The annealing is performed on a temperature below the recrystallisation temperature, practically on a temperature between 1500–1900° K. The annealing serves to relieve the stresses built up during the metalworking process. The annealing may comprise several heating and cooling cycles. In case of a coiled or coiled-coiled filament, the coiling is also done before the final annealing.

Thereafter the filament is recrystallised at a temperature above the recrystallisation temperature, see step 36 in FIG. 3. For filaments with the proposed composition, it will mean temperatures below 2750° K. After the recrystallisation the filament has a stable crystal structure, and practically all grains are formed as elongated interlocking grains. The resultant GAR of the grains is not less than 12, but often higher for thinner wires. The recrystallisation is done in furnace, and the filament is disposed on a mechanical support during the recrystallisation. Usually, the mechanical support comprises a tungsten boat or a tungsten mandrel.

The interlocking grain structure showing good non-sag qualities during operation of the filament is in close correlation with the hot tensile strength (HTS) of tungsten wires used for filament production, measured at high temperature (1620° C.). Below the non-sag qualities, i.e. the HTS of the filament is demonstrated, compared with the HTS values of known AKS-doped tungsten materials.

TABLE I

Hot tensile strength (HTS) [N/mg/200 mm], measured at 1620° C.

| Wire size [μm] | traditional AKS wire | Wire produced by the method |
|---|---|---|
| 150 | 0.163–0.173 | 0.173–0.189 |
| 200 | 0.148–0.158 | 0.168–0.178 |

Another test was performed with the low rhenium content filaments in halogen headlight bulbs of 120V/650W nominal power, with rated service life of 100 hours. The filaments of the lamps was produced from 0.3% Re content tungsten wire. The results of the service life test of the mass produced lamps showed that the filaments made with the method had a service life 30–40% longer than lamps with only AKS doped filaments.

The filaments made according to the invention may be used advantageously in incandescent lamps, e.g. as the headlight lamp 30 shown in FIG. 9. The lamp 30 is a tungsten halogen lamp, with a glass envelope 15. The envelope 15 encloses a filament 12, which latter is similar to the filament 12 shown in FIG. 1. The filament 12 is welded to molybdenum plates 25 and 26. The ends 21 and 22 of the envelope 15 are pinch or shrink sealed around the molybdenum plates 25 and 26. The connecting electrodes 23 and 24 are welded to the molybdenum plates 25 and 26. The filament 12 in the envelope 15 is a tungsten-rhenium filament comprising AKS additive. The filament has a rhenium content of 0.2–0.4% by weight, and it was made with the method described above. This results in a grain microstructure comprising substantially exclusively elongated interlocking grains with a Grain Aspect Ration (GAP) not less than 12. Thereby long lifetime and reliable operation of the lamp 30 is facilitated.

The invention is not limited to the shown and disclosed embodiments, but other elements, improvements and variations are also within the scope of the invention.

What is claimed is:

1. A tungsten-rhenium filament for an operating temperature between 2900 and 3200° K, the filament comprising an aluminum-potassium-silicon (AKS) additive, and having a grain microstructure comprising substantially exclusively elongated interlocking grains with a Grain Aspect Ratio (GAR) not less than 12 and having a rhenium content of 0.2–0.4% by weight.

2. The filament of claim 1 in which the rhenium content is 0.3% by weight.

3. The filament of claim 1 in which the GAR is not less than 50.

4. The filament of claim 1 in which the GAR is not less than 100.

5. The filament of claim 1 in which the rhenium is uniformly distributed in the volume of the tungsten.

6. The filament of claim 1 in which a diameter of the filament is between 100 and 400 microns.

7. The filament of claim 1 in which the filament comprises less than 100 ppm potassium.

8. The filament of claim 1 in which the filament comprises less than 10 ppm silicon.

9. The filament of claim 1 in which the filament comprises less than 13 ppm aluminum.

10. The filament of claim 1 in which the filament is a single coiled or coiled-coiled filament.

11. A method for manufacturing a rhenium-tungsten filament, comprising the following steps:

preparing an AKS doped tungsten-rhenium alloy powder having a rhenium content of 0.2–0.4% by weight;

pressing and presintering the alloy powder;

sintering the alloy powder with direct current;

forming a rhenium-tungsten filament of the sintered alloy with a metastable crystal structure;

annealing the filament while in the metastable crystal structure at a temperature below the recrystallisation temperature;

recrystallising the filament at a temperature above the recrystallisation temperature to achieve a stable crystal structure having substantially exclusively elongated interlocking grains with a GAR not less than 12;

said filament having an AKS additive and a rhenium content of 0.2–0.4% by weight.

12. The method of claim 11 in which the filament is coiled before the annealing.

13. The method of claim 11 in which the recrystallisation is made on a temperature not higher than 2750° K.

14. The method of claim 11 in which the recrystallisation is done in furnace, and the filament is disposed on a mechanical support during the recrystallisation.

15. The method of claim 11 in which the mechanical support comprises a tungsten boat or a tungsten mandrel.

16. A halogen incandescent lamp comprising a glass envelope enclosing a tungsten-rhenium filament, the filament comprising AKS additive, and having a grain microstructure comprising substantially exclusively elongated interlocking grains with a Grain Aspect Ration (GAR) not less than 12 and having a rhenium content of 0.2–0.4% by weight.

17. The lamp of claim 16 in which the lamp comprises a filament having a rhenium content of 0.3% by weight.

* * * * *